United States Patent [19]

Suda

[11] 4,152,866

[45] May 8, 1979

[54] ELECTRICALLY DRIVEN TRAVELLING TOY

[75] Inventor: Kataro Suda, Tokyo, Japan

[73] Assignee: Suda Kinzoku Seisakusho Co., Ltd., Tokyo, Japan

[21] Appl. No.: 777,675

[22] Filed: Mar. 15, 1977

[30] Foreign Application Priority Data

Aug. 17, 1976 [JP] Japan ..... 51-110172

[51] Int. Cl.[2] ..... A63H 17/00; A63H 33/26

[52] U.S. Cl. ..... 46/251

[58] Field of Search ..... 46/251, 262, 264

[56] References Cited

U.S. PATENT DOCUMENTS

| | | | |
|---|---|---|---|
| 3,538,640 | 10/1970 | Hayes et al. | 46/251 |
| 3,818,632 | 6/1974 | Tong | 46/262 |

*Primary Examiner*—Louis G. Mancene
*Assistant Examiner*—Robert F. Cutting

[57] ABSTRACT

An electrically driven toy in which a transmission mechanism is disengaged through a manually operated change-over means from the driving power source when the energization of the power source is interrupted.

4 Claims, 5 Drawing Figures

ELECTRICALLY DRIVEN TRAVELLING TOY

BACKGROUND AND SUMMARY OF THE INVENTION

This invention relates to a toy which is driven by an electric motor.

Hitherto, a toy of the type referred to has been arranged so that a transmission mechanism is still associated with a driving power generation mechanism even after an operation of the motor has been ceased. Accordingly, when the toy is constrained to travel or move after the operation of the motor has been stopped, the transmission mechanism and/or the driving mechanism would be subjected to damage or trouble.

It is therefore a general object of the invention to provide an electrically driven toy which is left free to move even after the operation of the driving power source has been stopped without however damaging the driving as well as transmission mechanisms.

To achieve the foregoing purpose in accordance with the invention the transmission mechanism is disengaged through a manually operated changeover means from the driving power source when the energization of the latter is interrupted.

The invention will be better understood and additional objects and advantages will become apparent from the following description of the preferred embodiment illustrated in the accompanying drawings. Various changes may be made, however, in the details of construction and arrangement of parts and certain features may be used without other. All such modifications within the scope of the appended claims are included in the invention.

BRIEF DESCRIPTION OF THE DRAWINGS

The invention will now be described in greater detail with reference to the accompanying drawings, wherein.

PREFERRED EMBODIMENT OF THE INVENTION

Figure 1:
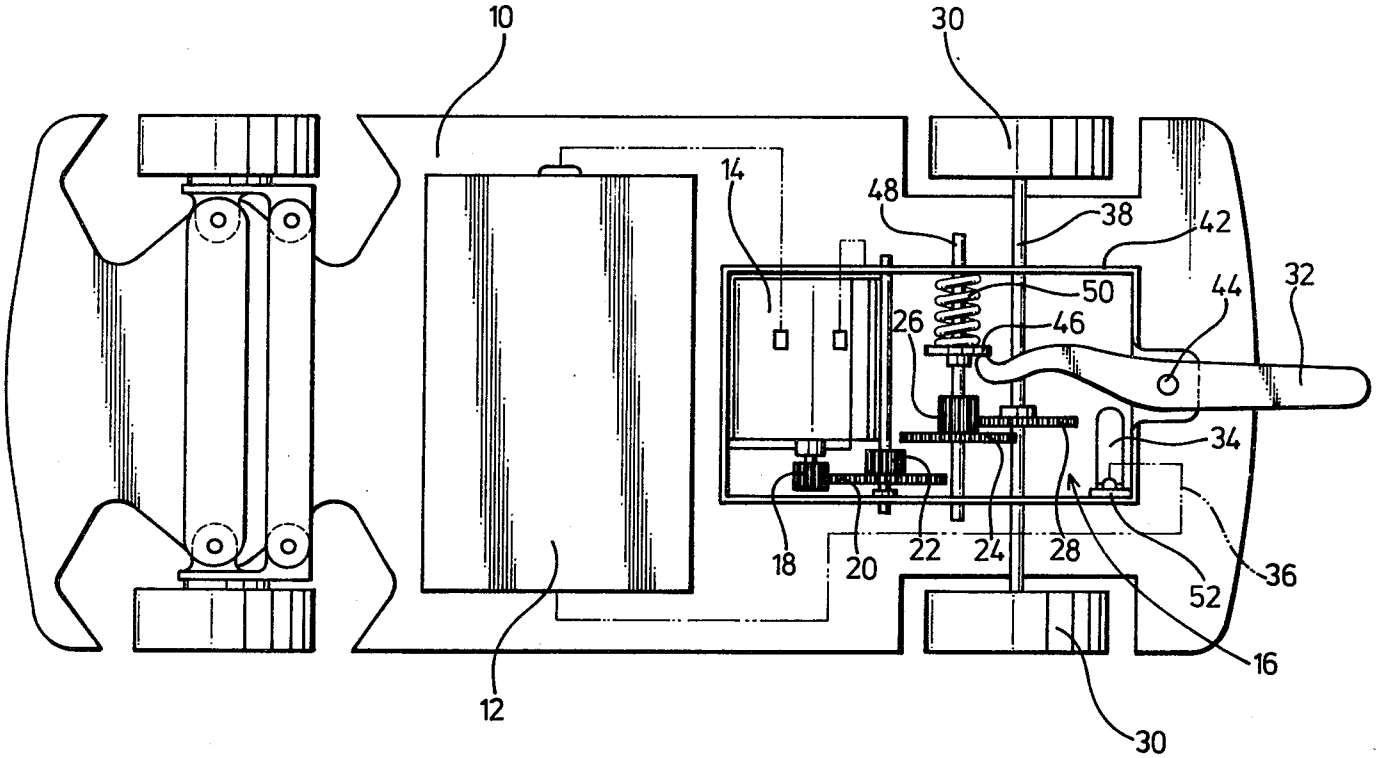
FIG. 1 is a plan view of the electrically driven toy with the transmission mechanism in the position disengaged from the driving power source.

In the accompanying drawings, the electrically driven toy comprises a chassis member 10 bearing an electric cell 12 connected to a driving power motor 14 and a transmission mechanism 16 including driving and driven gears 18 to 28 for transmitting the driving power from the driving power source to the driven wheels 30. Intermediate gears 24 and 26 are axially movable by means of a change over lever 32 which is in or out of connection with an electric connecting piece 34 constituting a part of an electric circuit 36. When the intermediate driven gear 24 is disengaged from the driving gear 22, the lever 32 is separated from the connecting piece 34. While, when the intermediate driving gear 22 is in mesh with the intermediate driven gear 24, the lever 32 is in contact with the connecting piece 34.

A shaft 38 bears an intermediate driven gear 28 with wheels 30. The lever 32 is rocked to a conductive frame member 42 through a pivot pin 44. A disc member 46 is journaled on a shaft 48 with a coil spring 50 mounted thereon between the disc member 46 and the frame member 42 to always urge the intermediate driven gear 24 on the shaft 48 to the position where the intermediate driven gear 24 coacts with the driving gear 22 as best shown in FIG. 2. When the change-over lever 32 is operated to push at its tip end the disc member 46 resisting to the function of the spring 50, the intermediate driven gear 24 is disengaged from the driving gear 22 as shown in FIG. 1.

When the lever member 32 is changed the intermediate driving gear 22 comes to co-act with the driven gear 24 under and within the function of the spring 50, so that the transmission mechanism and other parts are not subjected to undesired trouble or damage until the driving gear 22 comes to co-act with the driven gear 24.

Figure 2:
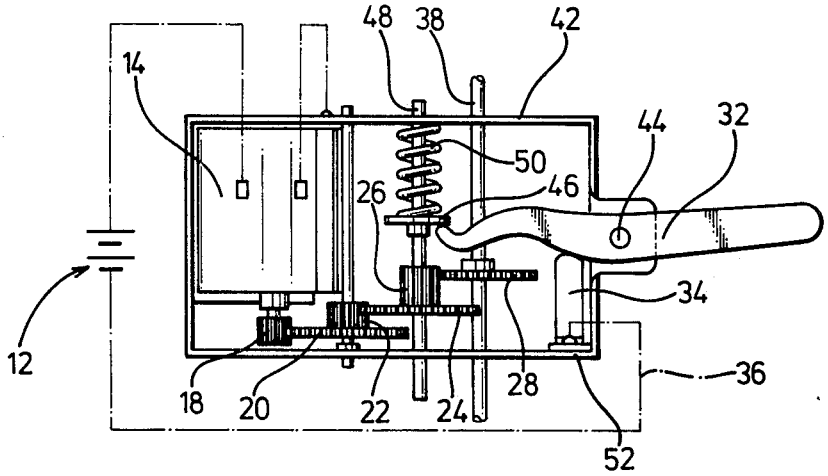
FIG. 2 is a plan view of the transmission mechanism in the position engaged with driving power source.

On the other hand, when the lever 32 is operated to fall in the position as shown in FIG. 1 resisting to the function of the spring 50 with disengagement of the intermediate driven gear 24 from the intermediate driving gear 22, such the position may be maintained through a possible fliction between the lever member 32 and the frame member 42 or the pivot pin 44.

The reference numeral 42 represents an insulating layer interposed between the frame member 42 and the contacting piece 34 and 52 denotes the front wheels.

When the lever member 32 is made into contact with the connecting piece 34, a closed circuit of from the battery 12—the connecting piece 34—the lever member 32—the frame member 42—the motor 14—the battery 12 is obtained to energize the electric motor 14. In this stage, the intermediate driven gear 24 is in mesh with the intermediate driving gear 22, so that the power revolusion of the motor 14 is transmitted through the transmission mechanism 16 to the wheels 30.

Again returning to FIG. 1, when the lever member 32 is changed for disengagement from the connecting piece 34 to interrupt the power supply to the motor 14, the driven gear member 24 is disengaged from the driving gear member 22, so that the power supply line from the motor 14 to the wheels 30 is cut off. Accordingly, in this position, when the wheels 30 are contrained to turn, the intermediate gears 24 and 26 are subjected to an idling and no turning motion is transmitted to the driving gear 18 secured to a driving shaft of the motor 14.

Figure 5:
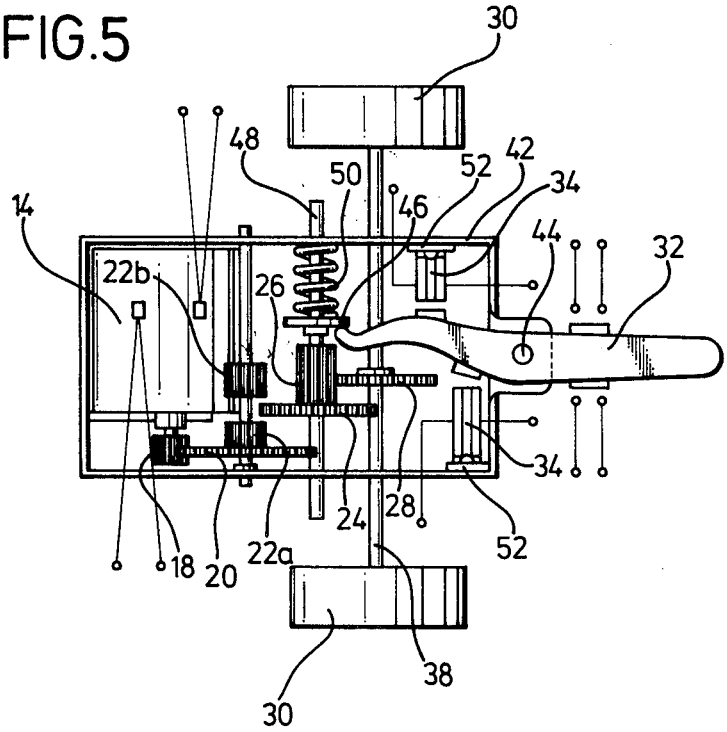
FIG. 5 is a plan view of the transmission of FIG. 4 but in disengagement with the driving power source.
Figure 3:
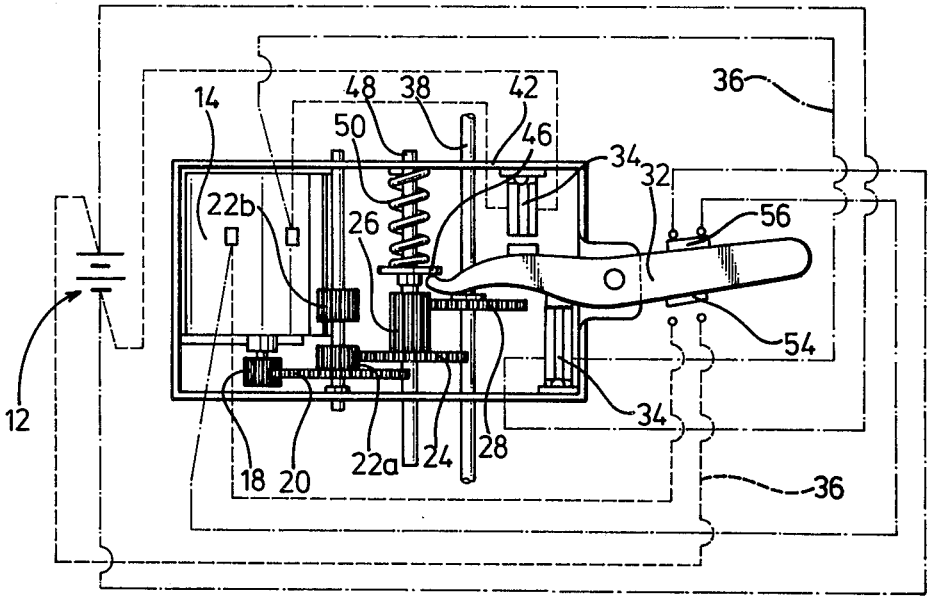
FIG. 3 is a plan view of the transmission mechanism of another embodiment in engagement with the driving power source for the normal operation.
Figure 4:
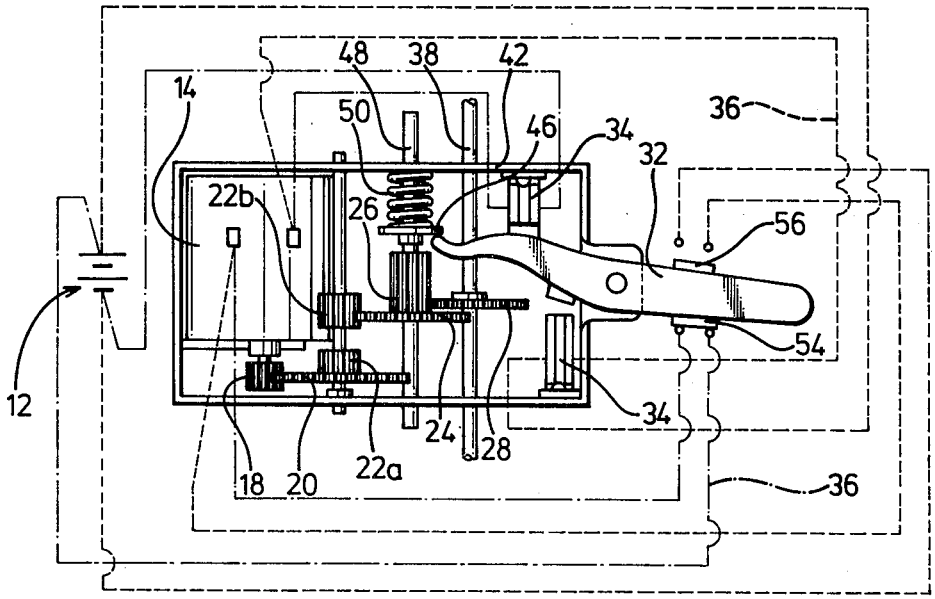
FIG. 4 is a plan view of the transmission mechanism similar to FIG. 3 but in the position of reversing operation.

In another embodiment of the invention, the change-over lever 32 may be operated in three positions as shown in FIGS. 3 to 5 respectively and in the intermediate position the driving gear 22 is disengaged from the driven gear 24 whereas in the remaining two positions the lever member 32 is made into an electrical and selective contact with two electric contacts 54 and 56 thereby to constitute a reversible change over circuit in combination of the connecting piece 32 with the contacts 54 and 56. Thus, the wheels 30 may selectively be changed into an idling position, a normal advancing position and a reversing position.

What is claimed is:

1. An electrically driven toy comprising a frame, having wheels rotatably carried thereon, an electric motor, an electric circuit for operating said motor, a selectively engagable gear transmission connecting said motor and said wheels and a control lever electrically interposed in said electric circuit and mechanically interposed in said gear transmission, said control lever being arranged to selectively operate said toy in a running mode by simultaneously engaging said gear transmission and completing said electric circuit and in an idling mode by simultaneously disengaging said gear transmission and opening said electric circuit.

2. An electrically driven toy according to claim 1 wherein the gear transmission comprises a driving gear member connected to said motor, a driven gear member connected to said wheels and a gear member axially movable into and out of coupling engagement with at least one of said driving or driven gear members; said control lever being pivotably carried by said frame operable to move said axially movable gear member and connectable with an electrically conductive element; said electric circuit connecting said motor to electric source, said electrically conductive element and said lever member; said lever member being arranged on said frame for movement between a first position such as to cause the axially movable gear to be disengaged from at least one of said driving and driven gear members and to simultaneously separate the lever member from the said electrically conductive element to open said electric circuit and a second portion wherein said axially movable gear member is coupled operatively with both said driving and driven gear members and the lever member is in contact with said electrically conductive elements to close said electric circuit.

3. An electrically driven toy as claimed in claim 2, including a pair of electrically conductive elements connectable with said lever member, said lever being shiftable into contact with either of said conductive elements or to a position therebetween and out of contact with both of said conductive elements, said conductive element connecting said power source to opposite electric poles to thereby effect reversal of operation of said power source, at least one of said driving or driven gear members having a portion being out of coupling engagement with said axially movable gear member when said lever member is positioned out of contact with both said conductive elements, wherein said lever member is movable to operate said toy in three stages including normal advancing stage; idling stage and reversing stage.

4. An electrically driven toy as claimed in claim 2, wherein the axially movable gear member is mounted on an axially shiftable shaft which bears a disc member with a resilient member in engagement with one end of said control. lever.

* * * * *